US007976398B2

(12) United States Patent
Clawson

(10) Patent No.: US 7,976,398 B2
(45) Date of Patent: Jul. 12, 2011

(54) GOLF SWING FORMATION AID

(76) Inventor: Thomas S. Clawson, Las Vegas, NV (US)

( * ) Notice: Subject to any disclaimer, the term of this patent is extended or adjusted under 35 U.S.C. 154(b) by 0 days.

(21) Appl. No.: 12/460,087

(22) Filed: Jul. 13, 2009

(65) Prior Publication Data

US 2011/0009203 A1 Jan. 13, 2011

(51) Int. Cl.
*A63B 69/36* (2006.01)

(52) U.S. Cl. ..... 473/212; 473/219; 473/227

(58) Field of Classification Search ..... 473/207, 473/212–214, 219, 227, 266, 276
See application file for complete search history.

(56) References Cited

U.S. PATENT DOCUMENTS

| | | | | |
|---|---|---|---|---|
| 5,096,199 | A * | 3/1992 | Wyatt et al. | 473/212 |
| 5,259,621 | A * | 11/1993 | Keefer | 473/212 |
| 5,735,776 | A * | 4/1998 | Swezey et al. | 482/91 |
| 5,839,968 | A * | 11/1998 | Latella | 473/219 |
| 6,358,156 | B1 * | 3/2002 | Moran | 473/219 |
| 7,033,284 | B2 * | 4/2006 | Yoshimura | 473/276 |

* cited by examiner

*Primary Examiner* — Nini Legesse
(74) *Attorney, Agent, or Firm* — Thomas A. Turner, Jr.

(57) ABSTRACT

A golf swing formation aid has a resilient cushion sandwiched between two additional resilient cushions, with sleeves to receive the arms of a golfer holding a golf club to provide between the arms a predetermined spacing during a swing of the golf club by the golfer. A differential in the resilience of the cushions allows for accommodation of the movement of the arms during the swing while maintaining the predetermined spacing. The cushions have different degrees of resilience.

16 Claims, 4 Drawing Sheets

GOLF SWING FORMATION AID

BACKGROUND OF THE INVENTION

1. Field of the Invention

The present invention relates to the art of golf, and more particularly to the art of golf club swinging and instructional aids and methods for improving a golfer's golf club swing.

2. Description of the Prior Art

In the past, it has been known to provide various implements to assist golfers in improving their play. Some of such implements are designed to be used while the golfer actually plays, while other implements are designed to be used during practice sessions to assist or to help the golfer learn to play the game. It is believed that the movements of the golfer are instrumental to the end result of the movement of the golf ball. Of the various movements of the golfer during play, the gold club swing is thought to be very important. Consequently, many implements have been designed to assist a golfer in his swing. Some of such implements can be used during actual play. Other implements are practical only in practice or learning sessions prior to play.

Essentially, the game of golf is the art of propelling a golf ball, one of the smallest balls in the field of sports, a relatively long distance, oftentimes being hundreds of yards, into a hole only slightly larger than the ball itself. The propulsion is accomplished by swinging a selection of golf clubs having a head at one end with which to strike the ball. To a certain extent, the club is an extension of the arms of the golfer, allowing the golfer to stand relatively erect while striking the ball which is normally on the ground.

While there is limited selection of golf clubs from which a golfer may choose, the sizes and shapes of golfers is as unlimited as the human species itself. Many golf aids have been devised to help a golfer play or learn during putting, that is to say, during the play that is close or proximal to the hole, such as, for examples, U.S. Pat. No. 7,033,284 to Yoshimura and U.S. Pat. Application No. 2008/002665 of Kelley. Because of the varying sizes and shapes of golfers, many of such devices provide for various articulated adjustments in order for the device to accommodate the particular golfer's unique shape, as shown, for one example, in U.S. Pat. No. 7,033,284, cited above.

Other golf swing aids are designed to assist a golfer to improve his ability to hit the ball greater distances. See, for example, U.S. Pat. No. 5,096,199 to Wyatt, Jr., et al. Again, as seen in that reference, the devices generally are elaborate and provide for articulation. Of necessity, many of such devices require such articulation in order that the device may accommodate the unique shape and/or size of the golfer. Moreover, as seen in that reference, many of the golf swing aids provide intricate designs for not only controlling the arms of the golfer, but also for controlling the legs, as well. Many of such prior art devices are designed to rigidly control the position of the arms to the body, and to control the position of the arms to the legs, and the legs to each other.

While many of such devices known in the art will provide benefit to a golfer learning or adjusting his or her strokes during practice sessions, such devices generally would be awkward if one attempted to use them on the golf course itself during actual play.

It is an object of the present invention to provide a golf swing formation aid that does not require adjustment of articulated parts in order to accommodate the golfer in the aid. It is a further object of the present invention to provide a golf swing formation or instructional aid that will accommodate a wide range of golfers' sizes and shapes. It is yet a further object of the present invention to provide a golf swing practice aid that can be donned easily and quickly, yet used repeatedly. Still another object of the present invention is to provide a golf swing instructional and formation aid that can be used not only during off-play practice sessions, but may be used during play on the golf course without unnecessarily impeding the play or wasting the time of other players on the golf course.

Still yet a further object of the present invention is to provide a golf swing instructional or formation aid that assists a golfer in spacing his arms during and throughout the full swing of a golf club. Even a further object of the present invention is to provide a golf swing aid that is not so rigid as to impede the natural varying positions of the arms relative to each other during a full or even a limited golf club swing.

SUMMARY

In brief, in accordance with one aspect of the present invention, at least two cushions are formed together in a generally inverse trapezoidal shape to be positioned between the arms of a golfer holding a golf club. The cushions have a sleeve on each side to receive the corresponding left or right arm of the golfer. At least one of the cushions has a degree of resilience more stiff than the other. In one aspect of the invention, a central cushion is sandwiched between two additional cushions, where the degree of resilience of the two sandwiching cushions is more stiff than the resilience of the central cushion. A cover for the cushions contains sleeves which allow for the swift and comfortable reception of the arms of the golfer. An optional or retractable plastic stiffening sheet provides for additional restraint for novice or powerful golfers.

These and other novel aspects of the present invention, together with other aspects thereof, can be better understood by the following detailed description of the preferred embodiments, which are designed to be read in conjunction and together with the accompanying drawings.

DESCRIPTION OF THE PREFERRED EMBODIMENTS

Figure 1:
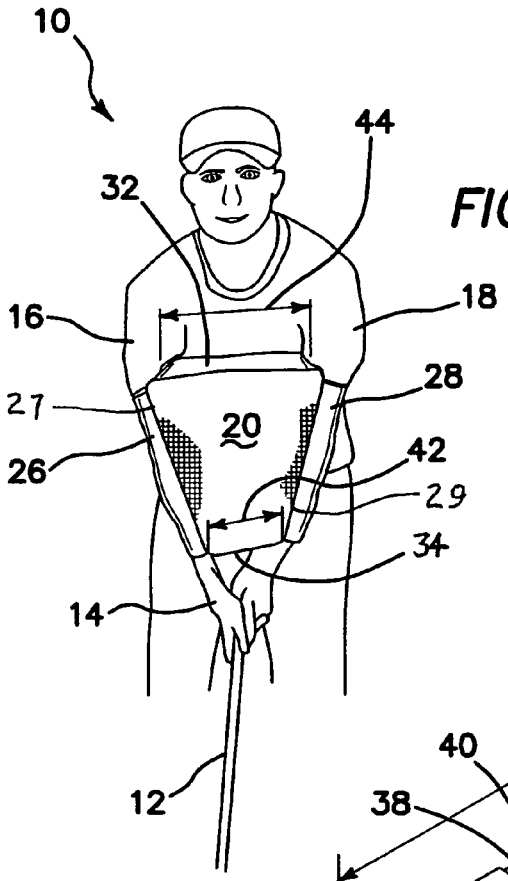
FIG. 1 is a perspective view of the golf swing aid of the present invention shown in use by a golfer.

A golfer 10 is shown, reference being had initially to FIG. 1 of the accompanying drawings wherein reference numerals refer to like numerals used in this specification. The golfer 10 is shown holding a golf club 12 with his hands 14. The golfer's right arm 16 and his left arm 18 are spaced apart by a cushion assembly 22 of the golf swing formation or instructional aid 20, which cushion assembly 22 is shown in greater detail in FIG. 2 of the accompanying drawings.

Figure 2:
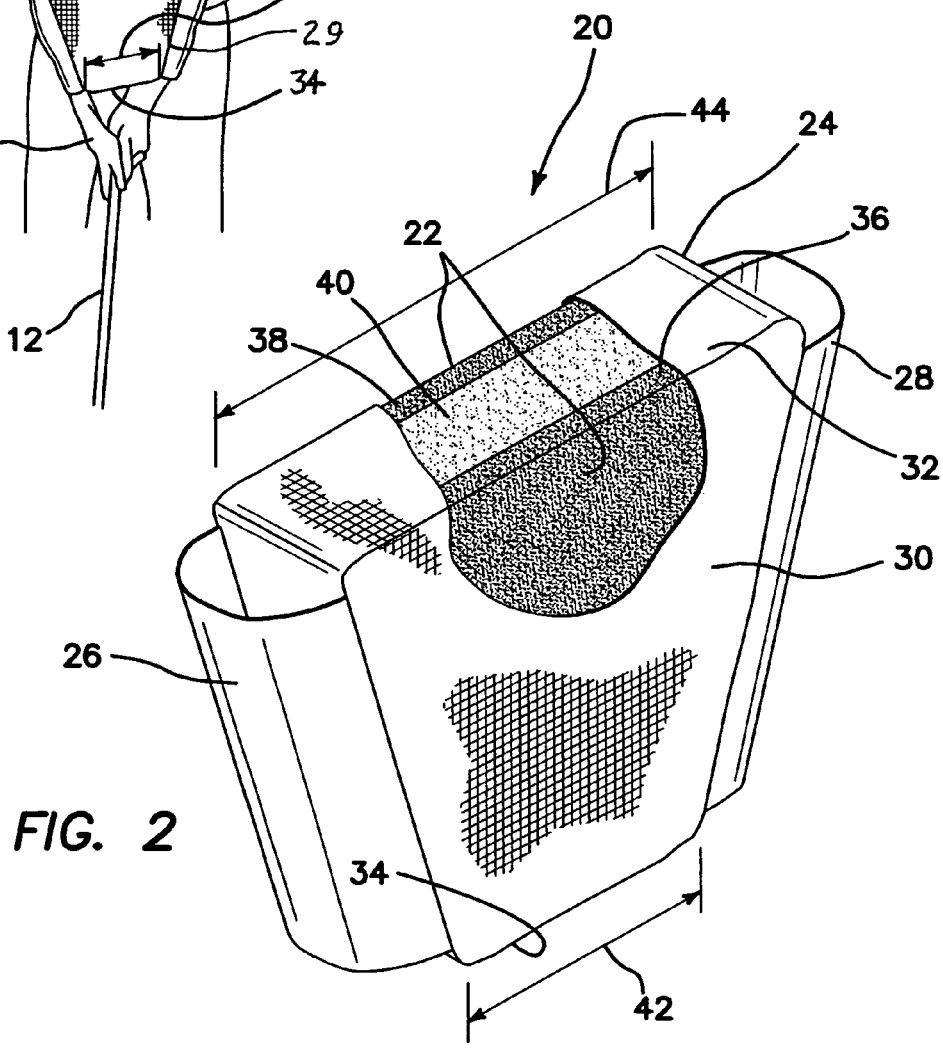
FIG. 2 is a perspective view of one embodiment of the golf swing aid of the present invention, having portions thereof removed to show interior aspects thereof.

The golf swing aid 20 has a cover 24 for holding the cushion assembly 22. A right sleeve 26 is positioned along the right side 27 of the cushion assembly 22. A left sleeve 28 is positioned along the left side 29 of the cushion assembly 22. The golfer's right arm 16 is inserted in sleeve 26, and his left arm 18 is inserted in the left sleeve 28 of the swing aid 20. The cover 24 has a face or front 30, a top 32 and a bottom 34. A plurality of straps, cords or like holding devices may be provided in lieu of a sleeve 26, 28, so long as the holding devices keep the corresponding arm 16, 18 in close proximity to the corresponding side of the cushion assembly, as shown in FIGS. 1 and 2. Hereinafter in this specification and accompanying claims, whenever reference is made to a sleeve or to sleeve means, it is to be understood that such terms mean, and reference is being made to, such holding devices.

The cushion assembly 22 comprises a first or front cushion 36 which is made of a resilient material. The cushion assembly 22 also comprises a second or back cushion 38 having substantially the same composition as the front cushion 36. A third cushion 40 is fixed to and between the front cushion 36 and the second or back cushion 38 to form the assembly 22, which comprises a sandwich of the three cushions 36, 38, 40. The degree of resilience of the cushion 40 is less stiff than that of the front cushion 36 and that of back cushion 38.

The length 42 of the bottom 34 is shorter than the length 44 of the top 32 of the cushion assembly 22, resulting in a generally inverse trapezoidal shape for the swing aid 20. The shape thus forces the swing aid 20 to position arms 16, 18 held by the corresponding sleeves 26, 28 spaced apart yet in a generally "V" relationship with each other. This relationship is the relationship desired when holding a golf club, and is generally close to the position desired during the golf club swing.

Figure 3:
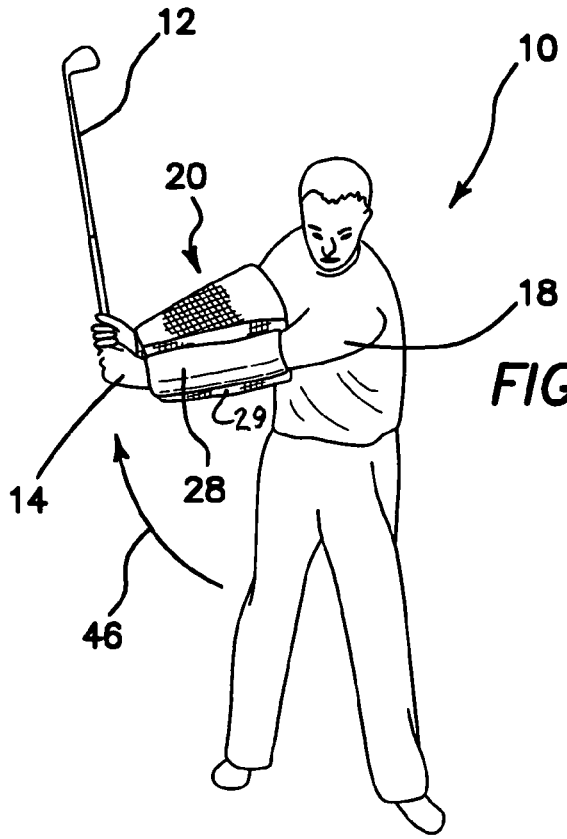
FIG. 3 is a perspective view of a golfer using one embodiment of the present invention during the up-stroke or back-stroke of the golf swing, showing the position of arms within sleeves in broken lines for ease of understanding.
Figure 4:
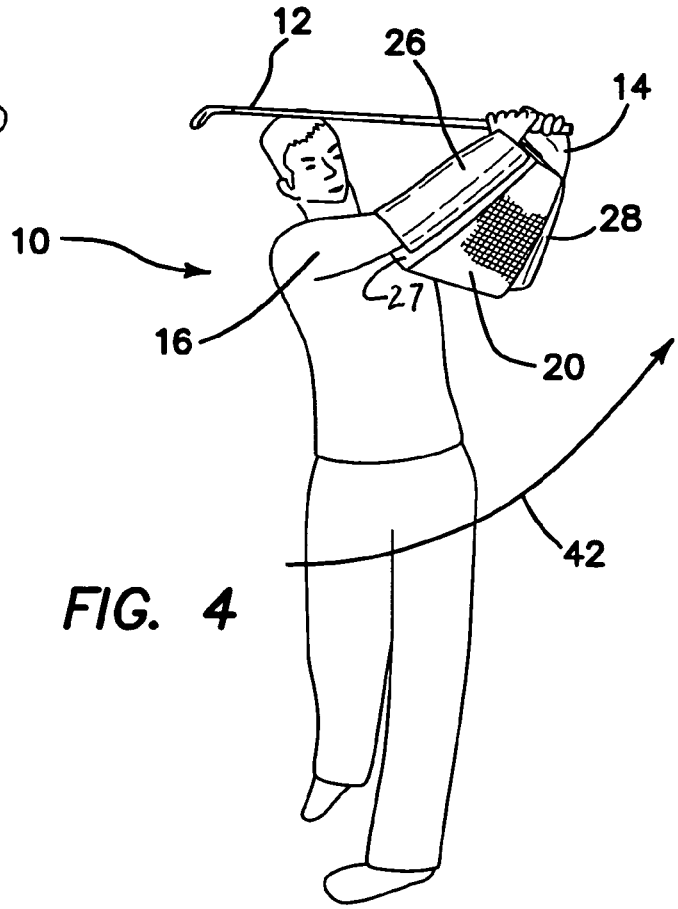
FIG. 4 is a perspective view of a golfer using one aspect of the present invention during the full follow-through of a golf swing, showing the position of arms within sleeves in broken lines for ease of understanding.

In operation, referring to FIGS. 3 and 4 of the accompanying drawings, the golfer 10 pulls back on the golf club 12 in the up-stroke or back-stroke of a golf club swing, better seen shown particularly in FIG. 3. The relationship of the arms 16, 18 to each other changes somewhat in this up-stroke 46, but the resilience of the cushion 40 easily accommodates this variable change by slight compression and by a torsional movement as well. Complete freedom for the arms 16, 18 is restricted or opposed by the more stiff resilience of the front cushion 36 and the back cushion 38. Front cushion 36 and back cushion 38 are composed of substantially the same material. The from cushion 36 and the back cushion 38 do not compress as readily as the core cushion 40, but rather slightly bow outward, as shown in FIG. 3, so that there is a constant pressure against or opposing the arms 16, 18 from coming closer together too much. Importantly, the arms 16, 18, especially at their elbows are urged to maintain their initial space or distance apart as when the golf swing initially began, as in the position shown in FIG. 1.

As the golfer 10 follows through with the swing, as indicated by the arrow 48 in FIG. 4, the center cushion 40, as well as the sandwiching cushions 36, 38 expand and compress as the club 12 proceeds to hit a golf ball. Further, the cushions 36, 38, 40 during the golf club swing and follow-through 48 have torsional movement in the opposite direction from the torsional movement during the up- or back-stroke 46. Still, the resilience of the cushions 36, 38, 40 urges and helps the golfer to maintain the proper spacing between his arms 16, 18 the proper distance and the proper relationship with the other arm.

It may be appreciated that each of the arms 16, 18 are easily inserted into, and retrieved from its corresponding sleeve 26, 28. The swing aid 20 can be compressed for carrying around, and can be quickly and efficiently donned for use, whether during practice sessions or during actual play. There are no articulated inter-connected component parts that require careful adjustments, tightening or assembly. The swing aid can be donned and removed without delay of the game for others, and only minimally for the golfer 10 himself.

While in this description of a preferred embodiment a cushion assembly 22 comprised of three cushions 36, 38, 40 fixed together in a sandwich has been shown, those skilled in the art may readily appreciate that other configurations of cushions may be perceived that will provide the swing aid of this present invention. Thus, for example, substantially beneficial results can be obtained with only two cushions, where one cushion has a degree of resilience more stiff than the other, where one cushion will compress more readily while the other cushion tends to bow rather than tending to compress. Further, the sleeves means could comprise bands or straps which can be fastened around the corresponding arms 16, 18. Still further, the cushion assembly 22 can be formed integrally with the sleeve mens 26, 28, and the cover 20 may be eliminated.

Figure 5:
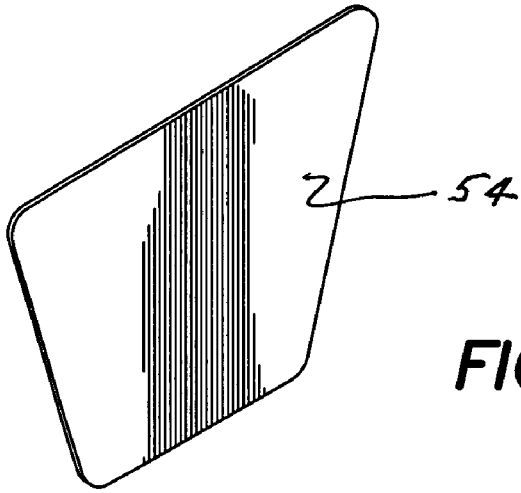
FIG. 5 is a perspective view of an insert element for the alternative embodiment of FIG. 6.
Figure 6:
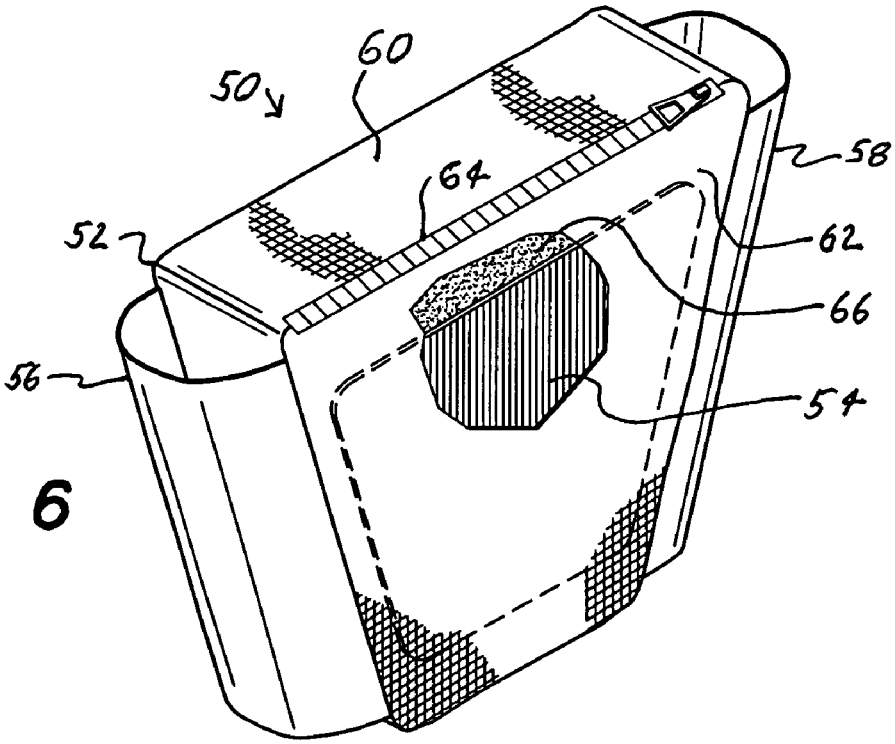
FIG. 6 is a perspective view of an alternative embodiment of the present invention, having portions of the front fabric cover cut away for clarity in viewing components within the fabric cover.

In FIGS. 5 and 6, an alternative embodiment of the golf swing instructional aid or swing formation aid 50 of the present invention is shown. The golf swing formation aid 50 has a fabric or cloth cover 52. The swing formation aid 50 has a right sleeve 56 and a left sleeve 58, similar to the sleeves 26, 28 of the embodiment as described above in the preferred embodiment. A sheet insert 54 comprising a relatively thin sheet of plastic or material having plastic characteristics is formed.

The cover 52 has a top portion or top 60 and a front portion or front 62. The top 60 and the front 62 of the cover 52 are joined together by a linear retractable fastening means 64. Such a linear fastening means could be a Zipper 64, as shown, but in all events should be capable of being opened and re-closed at the discretion of the golfer.

The swing formation aid 50 has internally resilient cushions sandwiched generally as shown for the preferred embodiment, including a front resilient cushion 66 corresponding to front cushion 36 of the swing formation aid 20 of the preferred embodiment. The thin sheet insert 54 has an inverse trapezoidal shape which is complemental to the shape of the swing formation aid 50, but having dimensions similar to but slightly less than that of the front 62 of the cover 52, so that the sheet insert 54 can be inserted inside the cover 52 between the front resilient cushion 66 and the front 62 within the cover 52.

In operation, the linear retractable fastening means 64 is opened and the thin sheet insert 54 is inserted within the fabric cover 52 and positioned between the front resilient cushion 66 and the inside of the front 62 of the cover 52. The retractable fastening means 64 is then closed. The generally inverse trapezoidal shape of the front resilient cushion 66 and the front 62 of the cover 52 the sheet insert 54 in place by the generally inverse trapezoidal shape of the insert 54.

The benefits of this alternative embodiment are best realized by the novice golfer and by the more powerful golfer, each of whom has a tendency to bring the back swing to a point where the hands of the golfer move towards and often touch the shoulder. The material of the sheet insert 54 should be substantially less resilient, that is to say, more stiff by bending in sheet form, as opposed to compressing and twisting as in the likes of cushions and cushion-like material as in the resilient cushions 66, 36, 38, 40 described here and above. Later, as the golf swing of the golfer improves or becomes more instinctive and natural to the golfer, the more stiff sheet insert 54 can be removed by opening the retractable fastener 64, gripping the sheet insert 54 and pulling it out. The golfer can then continuing obtaining the benefits of the swing formation aid 50 by using it without the stiffness that the insert 54 previously provided, but still feeling the resilience of the cushions 66 and other cushions within the cover 52.

Figure 7:
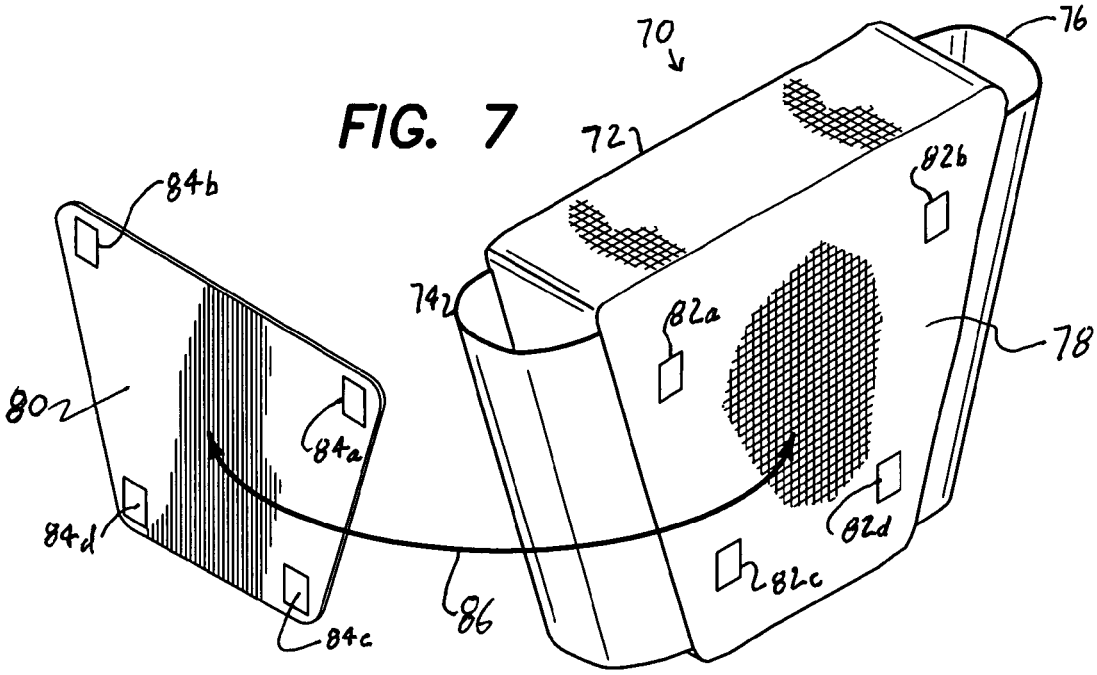
FIG. 7 is a perspective view of yet another alternative embodiment of the present invention having elements of this embodiment separated for clarity in describing one aspect of this alternative embodiment; and, FIG. 8 is a perspective view of the alternative embodiment of FIG. 7 showing the separated elements joined.
Figure 8:
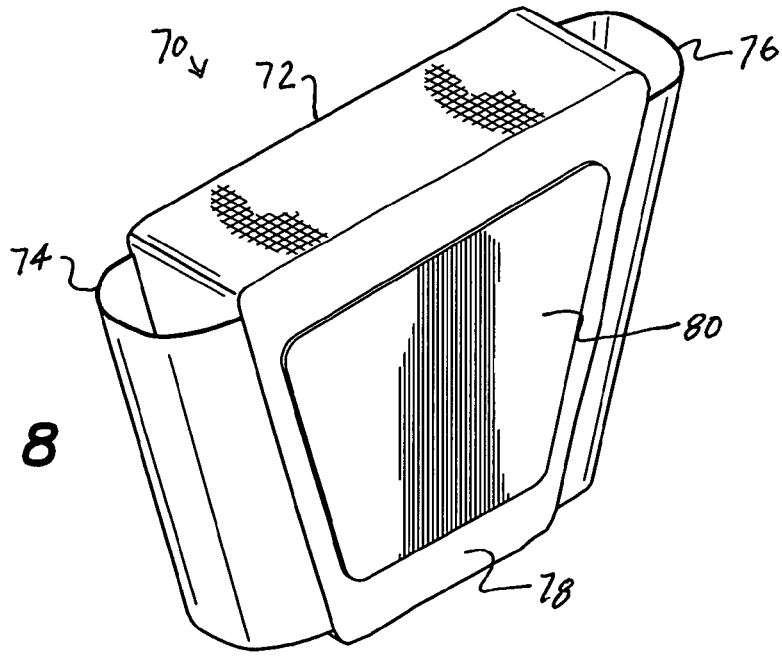

In FIGS. 7 and 8, yet another, second alternative embodiment to the preferred embodiment is shown in which a golf swing formation aid 70 has a cover 72, a right sleeve 74 and a left sleeve 76, similar to the aids of the preferred embodiment. The cover 72 includes a front portion or front 78, having the generally inverse trapezoidal shape of the aid 70.

In this second alternative embodiment, a relatively thin, stiff but bendable sheet 80 will provide the relative stiffness sometimes needed to prevent the golfer's hands and wrists from moving towards and sometimes touching his shoulder. In particular, the front 78 of the cover 72 has positioned near its four corners one part of a fastening material 82*a*, 82, *b*, 82*c*, 82*d*, such as, for example, the hook portion of Velcro strips. On one side of the sheet 80 are positioned strips 84*a*, 84*b*, 84*c*, 84*d* of the complemental portion of the fastening material, such as, for example, the matt portion of Velcro strips.

In operation, the sheet 80 is moved in the direction of arrow 86, best seen in FIG. 7, to be joined to the front 78 of the cover 72 of the swing formation aid 70. The fastening strip 84*a* is aligned with the fastening strip 82*a*. The fastening strip 84*b* is aligned with the fastening strip 82*b*. The fastening strip 84*c* is aligned with the fastening strip 82*c*. The fastening strip 84*d* is aligned with the fastening strip 82*d*. The sheet 80 is then fastened to the front 78 of the swing aid 70, as best seen in FIG. 8. The golfer can then use the swing aid 70 in much the same way and manner as the golf swing formation aids of the previously described embodiments. When the golfer's swing improves to the point where he does not have a tendency to move his hands 14 or wrists close to or touching his shoulder, he can easily remove the sheet 80 from the front 78 of the swing formation aid 70, and continue using the swing formation aid 70 as before but without the stiff restraint inherent in the sheet 80. If later the golfer prefers to have the relative stiff restraint provided by the sheet 80, the sheet 80 can easily re-fastened to the front 78 of the aid 70.

The foregoing detailed description of my invention and of preferred embodiments as to products, compositions and processes, is illustrative of specific embodiments only. It is to be understood, however, that additional embodiments may be perceived by those skilled in the art. The embodiments described herein, together with those additional embodiments, are considered to be within the scope of the present invention.

I claim:

1. A golf swing aid comprising in combination:

a. a cushion assembly comprising at least a first cushion having a generally trapezoidal shape, and a second cushion having a shape substantially similar to the trapezoidal shape of said first cushion and positioned adjacent said first cushion, said cushion assembly having a right side and a left side connecting a top side and a said base side, said top side being longer than said base side to form said generally trapezoidal shape, wherein said first cushion is comprised of a resilient material having a degree of resilience, and said second cushion is comprised of a resilient material having a degree of resilience which is more stiff than the degree of resilience of said first cushion;

b. first sleeve means connected along substantially the length of said right side of said cushion assembly, for receiving an arm of a user; and, c. second sleeve means connected along substantially then length of said left side of said cushion assembly, for receiving an arm of a user.

2. The golf swing aid of claim 1, wherein said cushion assembly further comprises a third cushion having a shape substantially similar to the trapezoidal shape of said first and said second cushions, positioned adjacent said first cushion, and wherein said third cushion is comprised of a resilient material having a degree of resilience which is more stiff than the degree of resilience of said first cushion.

3. The golf swing aid of claim 1, wherein said first and said second cushion means further comprise a cover substantially enclosing said cushion assembly.

4. The golf swing aid of claim 3, wherein said right sleeves means comprises a right sleeve, and said left sleeve means comprises a left sleeve, said cover holding said right sleeve and said left sleeve to said cushion assembly.

5. A golf swing aid for a person, comprising:

a. first sleeve means for receiving a right arm of said person;

b. second sleeve means for receiving a left arm of said person;

c. cushion means connecting said first and said second sleeve means a predetermined distance apart, said cushion means comprising at least a first resilient cushion and a second resilient cushion, where said first resilient cushion has a first degree of resilience, and said second resilient cushion has a second degree of resilience wherein said second degree of resilience is less stiff than said first degree of resilience of said first resilient cushion.

6. The golf swing aid of claim 5 wherein said cushion means further comprises a third cushion having a third degree of resilience substantially comparable to said first degree of resilience of said first resilient cushion, and wherein said second cushion is positioned between said first and said third cushions.

7. The golf swing aid of claim 5 wherein said cushion means is shaped generally in an inverse trapezoidal shape whereby said first and said second sleeve means generally converge toward each other from a top to a bottom of said swing aid.

8. The golf swing aid of claim 5 further comprising plastic sheet means selectively positionable adjacent said first cushion, wherein said plastic sheet means comprises a material that is substantially more stiff than said first cushion.

9. The golf swing aid of claim 8 further comprising cover means for containing said cushion means, wherein said cover means comprises a cover having opening means comprising an opening selectively opened and closed through which opening said plastic sheet means is selectively inserted and removed from within said cover.

10. The golf swing aid of claim 9 wherein said opening means comprises a zipper.

11. The golf swing aid of claim 8 further comprising cover means for containing said cushion means, and further comprising means for selectively fastening said plastic sheet means to said cushion means.

12. The golf swing aid of claim 11 wherein said fastening means includes a Velcro nap and hook fastener.

13. A golf swing formation aid comprising resilient cushion means for variably spacing a first arm and a second arm of a person holding a golf club in a predetermined, variable spaced relationship during a swing of the golf club, said cushion means having a generally trapezoidal shape and comprising means for receiving said first arm and said second arm.

14. The golf swing formation aid of claim 13 wherein said cushion means comprises at least a first and a second cushion, said second cushion having a degree of resilience less stiff than the degree of resilience of said second cushion.

15. The golf swing aid of claim 14 further comprising a third cushion having a degree of resilience comparable to the degree of resilience of said first cushion, and wherein said first and said third cushions sandwich said second cushion.

16. The golf swing aid of claim 14 further comprising a bendable sheet selectively positioned adjacent said first cushion.

* * * * *